US006130616A

United States Patent [19]

Sizemore

[11] Patent Number: 6,130,616

[45] Date of Patent: Oct. 10, 2000

[54] PERSONAL SECURITY BACKPACK

[76] Inventor: Edric Sizemore, 325 W. 118th St., Chicago, Ill. 60628

[21] Appl. No.: 09/314,365

[22] Filed: May 19, 1999

[51] Int. Cl.[7] ..... G08B 13/00

[52] U.S. Cl. ..... 340/574; 340/573.1; 340/693.5

[58] Field of Search ..... 340/537.1, 573.4, 340/693.5, 574, 328, 326, 331; 455/100, 351

[56] References Cited

U.S. PATENT DOCUMENTS

| | | | |
|---|---|---|---|
| 2,797,405 | 6/1957 | Stelter | 340/570 |
| 3,701,140 | 10/1972 | Dixon | 340/571 |
| 3,881,534 | 5/1975 | Gist | 150/111 |
| 3,893,096 | 7/1975 | Tucci et al. | 340/571 |
| 3,938,126 | 2/1976 | Ransom | 340/571 |
| 4,067,290 | 1/1978 | Hartley | 116/99 |
| 4,189,721 | 2/1980 | Boell | 340/539 |
| 4,223,804 | 9/1980 | Morris et al. | 222/3 |
| 4,376,935 | 3/1983 | Castaldo | 340/571 |
| 4,484,181 | 11/1984 | Schwartz | 340/521 |
| 4,755,802 | 7/1988 | Urbanczyk | 340/571 |
| 4,759,309 | 7/1988 | Zediker | 116/67 R |
| 4,762,082 | 8/1988 | Suchevits | 116/57 |
| 4,821,026 | 4/1989 | Newsom | 340/574 |
| 4,843,371 | 6/1989 | Kuei et al. | 340/539 |
| 4,885,570 | 12/1989 | Chien | 340/571 |
| 4,903,863 | 2/1990 | Fink | 222/61 |
| 5,022,340 | 6/1991 | Caraba | 116/77 |
| 5,389,916 | 2/1995 | Chen et al. | 340/650 |
| 5,477,205 | 12/1995 | Burns | 340/332 |
| 5,510,771 | 4/1996 | Marshall | 340/573.4 |
| 5,512,881 | 4/1996 | Majmudar | 340/574 |
| 5,541,579 | 7/1996 | Kiernan | 340/573.1 |
| 5,587,701 | 12/1996 | Hess | 340/541 |
| 5,652,569 | 7/1997 | Gerstenberger et al. | 340/573.4 |
| 5,748,089 | 5/1998 | Sizemore | 340/574 |

*Primary Examiner*—Benjamin C. Lee
*Attorney, Agent, or Firm*—Price, Heneveld, Cooper, DeWitt & Litton

[57] ABSTRACT

A personal security backpack emits visual and audio alarm signals for attracting attention to a crime scene or crisis situation powered by a portable battery pack and contained within a separate, readily accessible component compartment of the backpack. Two shoulder straps and a spacious main compartment for holding personal items are provided. The multi-alarm system remains concealed under an openable access flap that covers the entire component compartment. A smaller, rectangular flap section may be folded underneath the access flap to reveal a rectangular visual window in the component compartment. Two siren signal generators and a visual signal generator are disposed within the backpack proximate openings for generating loud distinguishable noise and a visual signal, with the sirens being unmuffled and pointed in opposite directions. A panic switch is mounted on the backpack's shoulder strap to provide easy access for activating the sirens and visual signal simultaneously. An adjustable anti-theft strap fastens across the chest, from one shoulder strap to the other, preventing the personal security backpack from easily being taken from the user.

16 Claims, 2 Drawing Sheets

12 VOLT MULTI ALARM CIRCUIT

PERSONAL SECURITY BACKPACK

FIELD OF THE INVENTION

The present invention relates to an improved personal security device. More particularly, the present invention teaches an improved portable personal security device having an audio and visual alarm for attracting attention to an emergency situation built into and concealed within a conventional-appearing backpack.

BACKGROUND OF THE INVENTION

Reports on crime continue to consume evening television and radio news broadcasts and fill the pages of newspapers throughout North America and other places in the world, particularly in urban areas. One practical solution is the use of devices by law-abiding citizens to attract attention to themselves when confronted by a criminal intent on committing a violent act. Various attempts have been made to address the foregoing problem of inconspicuous crimes against persons, at least at the primary crime scene. For example, in my U.S. Pat. No. 5,748,089, which is hereby incorporated by reference in its entirety, I disclosed a portable personal security system having multiple distress signals for attracting attention to a crime scene. The system includes a battery pack and is contained within the body of a carrying bag having a carrying strap, an interior component compartment and a space for holding personal items. A siren and a visual signal generator disposed within the component compartment proximate openings selectively generate a loud distinguishable noise and a visual signal. Preferably, an arming switch is first placed in an "armed" position, such that a panic switch simultaneously activates the siren and the visual signal.

In my U.S. Pat. No. 5,748,089, the preferred visual signal generator included a spark flare and an ignitor electrically mounted on a base plate disposed within the component compartment and connected with the battery pack. The visual signal could also be a high intensity strobe lamp electrically connected with the battery pack, whereupon actuation emits a high-intensity and high frequency light signal through the visual window. A panic switch comprised a rotatable key lock switch located on the inner front side of the external skin of the bag, having an "on" and "off" position operated by a removable key, where the system is activated only upon turning the key to the "on" position and can be deactivated upon turning the key to the "off" position. Alternatively, a key fob having a pressure sensitive switch coupled with a activation receiver disposed within the component compartment can serve as a panic switch, such that the system is activated only upon depression of the pressure sensitive switch and deactivated only upon turning the arming switch to the "unarmed" position. The system preferable included as a strap having a thin cable screwed into frame of the bag to avoid theft of the portable personal security system while being carried.

The aforementioned invention represented a significant improvement over the prior art. For example, one prior art approach is passive, as taught by U.S. Pat. No. 3,881,534, and includes a handbag provided with an detachable inner purse secured to a chain attached to the user. When a purse-snatcher attempts to forcibly steal the purse, the detachable inner purse holding the user's valuables remains attached to the user and defeats the objectives of the criminal. Although possibility "creating a scene" during the criminal event, such devices do not actively signal and accordingly do not effectively draw attention to the criminal act so that help can be summoned from other citizens or the police.

Other devices are disclosed in U.S. Pat. Nos. 3,701,140 and 4,067,290 as an audible alarm coupled between a woman's purse and purse handle. A sudden force exerted on the purse handle activates the audio alarm, such as during a purse snatching event. However, these devices are only operable during a purse snatching event and would be useless as a means of attracting attention for other, often more serious, crimes. Similarly, U.S. Pat. No. 4,759,309 discloses a hand-held audio alarm unit fueled by compressed gas that automatically activates when released, for example, through the sudden reaction of a crime victim. A drawback of this approach is that the automatic activation feature tends to promote false alarms and depletion of the compressed gas, possibly rendering it inoperative when needed.

U.S. Pat. No. 4,843,371 discloses a multi-alarm system for inducing a thief to drop a stolen briefcase. A flashing light is taught that is triggered, along with other features, when an incorrect lock combination is used or the briefcase is stolen. Nothing is disclosed that allows a panic alarm for the rightful carrier of the briefcase while it is being carried. In fact, it is taught that the briefcase is to be charged with high voltage, rendering it impossible for the rightful carrier to simultaneously carry the briefcase and activate a visual and audio alarm.

Another approach is found in U.S. Pat. No. 4,224,804. There, a triggering mechanism for providing effective and fail-safe activation is combined with a flashlight, a compressed gas source and a noise generator, dispersed dye and/or an odoriferous spray. U.S. Pat. No. 4,821,026 teaches a personal visual and audible alarm device, where the visual alarm consists of only streamers. U.S. Pat. Nos. 3,938,126 and 4,189,721 teach only a sound generator. U.S. Pat. Nos. 5,512,881 and 5,587,701 disclose more sophisticated alarm systems, but each primarily rely upon a sound generator as the alarm. The major shortcoming of these approaches, as with each of the foregoing examples of the personal alarms of the prior art, is that such devices relies on primarily sound as the means to attract attention to the crime scene. Especially in noisy or congested areas, sound alone is insufficient to immediately attract attention to the crime scene, especially at a distance.

Still other approaches are found in U.S. Pat. Nos. 3,893,096 and 4,376,935, where a handbag is provided with an audio alarm indicating unauthorized opening of the handbag. U.S. Pat. No. 4,755,802 does suggest the use of visual alarm rather than an audible alarm actuated upon unauthorized opening, but primarily contemplates an audio alarm. Alarm systems with an audio alarm only are taught for sensing a handbag handstrap being cut, as in U.S. Pat. Nos. 5,389,916, or sensing when a handbag itself is cut, as in U.S. Pat. No. 4,885,570. Again, sound alone may be insufficient to immediately attract attention to the crime scene.

While my U.S. Pat. No. 5,748,089 generally addressed and solved the aforementioned drawbacks in the prior art, it has been learned that improvements were still possible, particularly with regard to the nature of the bag, the compartment within which the combined visual signal generator and sound generator are housed and concealed, the compartment within which personal articles might be carried and the location and nature of the panic switch. More particularly, it has been found that a more utilitarian design for use by both women and men is desired, particularly in urban college and hospital campus found in many, if not most, urban areas and that a separate arming switch may be, in some circumstances, undesirable.

Also sought were improved anti-theft capabilities and an improved location so that the visual signal is more visible and the sound generator is most efficiently employed. Bags carried by hand are usually at or near a user's knees and bags carried under an arm are usually partially hidden by the arm. Both locations tend to interfere with the visual signal and tend to muffle the audio signal, limiting the effective range of the security device. Moreover, it is desired that an improved panic switch be provided that is conveniently located for immediate activation under virtually all circumstances, yet incapable of being conveniently turned off. Finally, a more efficient manner of carrying the security device was sought. Improved access to the compartment within which the alarm system is housed was desired, in order to improve the convenience of replacing the alarm system batteries.

SUMMARY OF THE INVENTION

In accordance with the foregoing drawbacks associated with the state of the art prior even in light of my U.S. Pat. No. 5,748,089, it is an object of the present invention to universally provide women, men and children with an effective device for portable personal security while away from home, where the device is easily carried within a bag having the appearance of a conventional backpack, the backpack further being capable of carrying other necessary and desired items. It is a further object of the present invention to provide a portable personal security system that will simultaneously emit substantially unmuffled audio and highly visual distress signals at higher relative height when activated that can be seen and heard for over great distances.

It is another object of the present invention to provide a portable personal security system which, once activated, will continue to function despite a criminal's attempt to shut the unit off.

It is still a further object of the present invention to provide women, men and children with a device that will carry everyday items within a large compartment, while the alarm system is housed in a separate and conveniently accessible compartment of the backpack.

A still further object of the present invention is to provide a portable personal security system provided with an anti-theft strap that fastens to both shoulder straps of the backpack, across the user's chest, such that the anti-theft strap prevents the personal security system from easily being taken from the user when activated.

Another object of the present invention is to provide a personal security backpack with an readily accessible panic switch mounted to one of the shoulder straps of the backpack.

These and additional objects of the present invention may be determined from a review of the instant disclosure, disclosing a personal security backpack having multiple distress signals for attracting attention to a crime scene or crisis situation. The system is powered by a battery pack and is contained within a separate, readily accessible component compartment of the backpack. Two shoulder straps and a spacious main compartment for holding personal items are provided. The personal security backpack's separate component compartment contains the multi-alarm system, which remains concealed under an openable access flap that covers the entire component compartment. A smaller, rectangular flap section, in the lower center, may be folded underneath the access flap to reveal a rectangular visual window in the component compartment. The multi-alarm system can also be constructed into the bottom section of the main carrying compartment.

Two siren signal generators and a visual signal generator are disposed within the component compartment proximate openings for generating loud distinguishable noise and a visual signal, with the sirens being unmuffled and pointed in opposite directions. A panic switch is mounted on the personal security backpack's shoulder strap to provide easy access for activating the sirens and visual signal simultaneously. An adjustable anti-theft strap fastens across the chest, from one shoulder strap to the other, preventing the backpack from being taken from the user.

Other objects, advantages and features of the invention will become apparent upon a consideration of the following detailed description, when taken in conjunction with the accompanying drawings. The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto.

In this respect, before explaining the preferred embodiment of the disclosure in detail, it is to be understood that the disclosure is not limited in its application to the details of the construction and the arrangements set forth in the following description or illustrated in the drawings. The personal security backpack of the present disclosure is capable of other embodiments and of being practiced and carried out in various ways. Also, it is to be understood that the phraseology and terminology employed herein are for description and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers and practitioners in the art who are not familiar with the patent or legal terms of phraseology, to learn quickly from a cursory inspection the nature and essence of the technical disclosure of the application. Accordingly, the Abstract is intended to define neither the invention nor the application, which is only measured by the claims, nor is it intended to be limiting as to the scope of the invention in any way.

These and other objects, along with the various features and structures that characterize the invention, are pointed out with particularity in the claims annexed to and forming a part of this disclosure. For a better understanding of the personal security backpack of the present disclosure, its advantages and the specific objects attained by its uses, reference should be had to the accompanying drawings and descriptive matter in which there are illustrated and described the preferred embodiments of the invention.

While embodiments of the personal security backpack are herein illustrated and described, it is to be appreciated that various changes, rearrangements and modifications may be made therein, without departing from the scope of the invention as defined by the appended claims.

DETAILED DESCRIPTION OF THE PREFERRED EMBODIMENT

The following is a description of the best mode presently contemplated for carrying out the invention. Other modes of carrying out the invention, without departing from the scope of the invention, will become apparent to those skilled in the art as the description proceeds.

Figure 1:
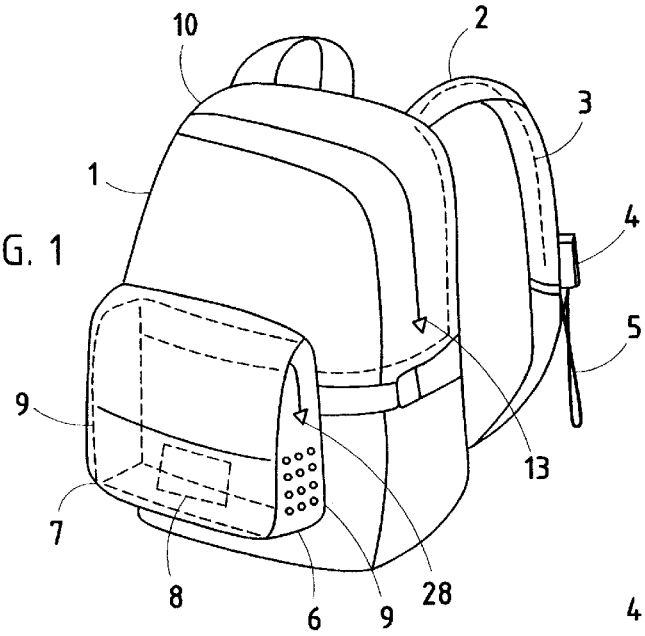
FIG. 1 is a perspective view of the personal security backpack of the present invention as it might be carried by a user, particularly showing the preferred panic switch wiring configuration.
Figure 3:
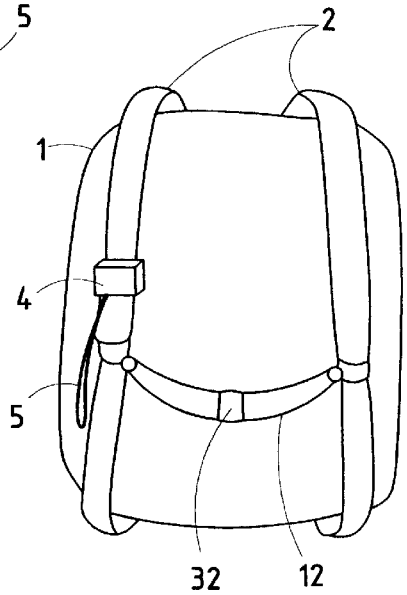
FIG. 3 is a plan front view of the personal security backpack of the present invention, particularly showing the preferred location for the panic switch.
Figure 2:
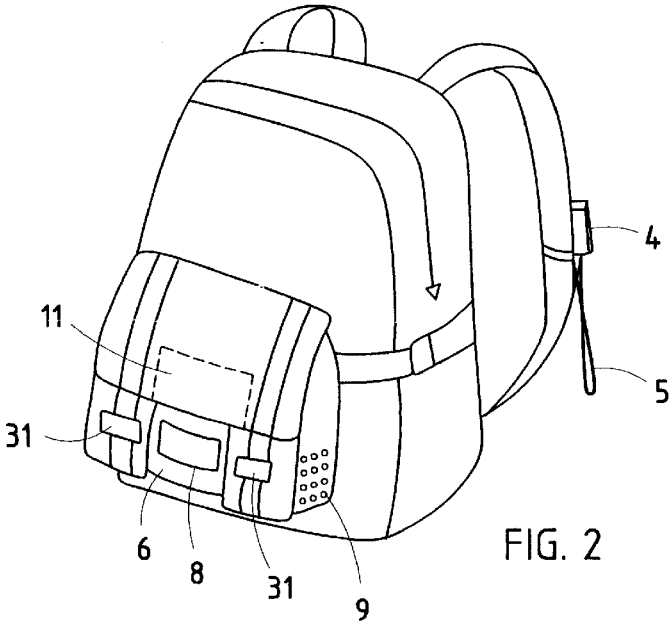
FIG. 2 is a perspective view of the personal security backpack system of the present invention.
Figure 4:
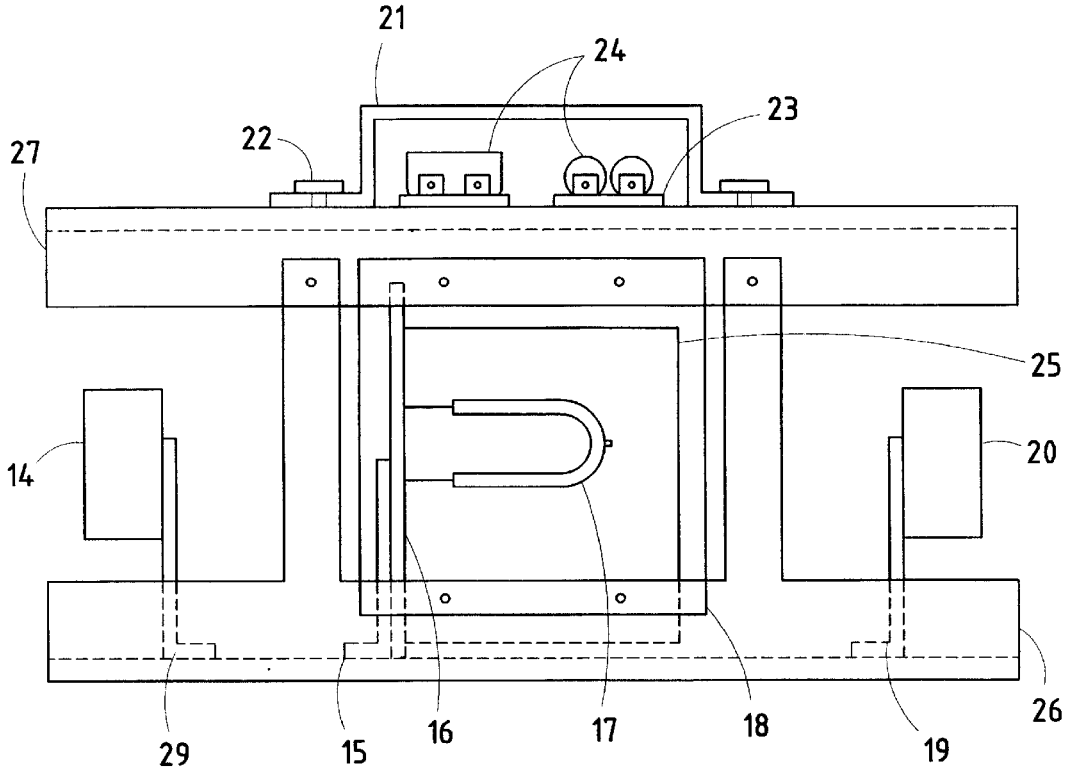
FIG. 4 is a cross-sectional view of the interior componentry of the personal security backpack of the present invention.

Referring to FIGS. 1 through 3, the preferred personal security backpack for application of the present invention is shown. Although the size and shape of the backpack can vary, the preferably size is 13 inches wide by 17 inches high by 8½ inches deep. As best seen in FIG. 1, the personal security backpack 1 is preferably constructed from 1000 denier DuPont Cordura nylon and is provided with a component compartment 6 and large carrying compartment 10. The carrying compartment 10 opens to reveal a spacious and fairly conventional backpack compartment with a closures or double zippers 13. The component compartment 6 houses the multi-alarm system of the present invention, the details of which are better shown in FIG. 4 as discussed below. A series of small opens are provided on each opposite lateral side of the component compartment 6 to form opposing siren windows 9 by which the audible siren of the present invention may by heard unmuffled and directly in nearly 360 degrees. By using a pair of sirens 14, 20 (as shown in FIG. 4), the probability of the audible alarm generator being pointed toward an area where there may be no observers is largely avoided. Thus, the effectiveness of the audible alarm is improved.

The component compartment 6 opens and fastens closed with double zippers 28. The component compartment 6 is further covered with a water resistant compartment flap 7 that is retained in place through detachable buckles 31, as is conventionally known. Preferably, the flap 7 further comprises a smaller rectangular strobe flap 11 that is capable of being folded underneath the compartment flap 7 to reveal a strobe window 8 through which a strobe lamp 17 may be seen. The strobe flap 11 is preferably retained in the folded position to the inside of the flap 7 by conventional hook and loop fasteners when the user believes that the security function might be needed, although other fastening means, such as snaps and hooks can be used. In other situations, the strobe flap 11 is unfolded to lie flat against the rear and along with the rest of the flap 7 to protect the strobe window 8 from damage. The strobe window 8 may be simply a cut out section of the rear wall of the component compartment 6, as shown in FIG. 2, although a window-like covering, such as acetate, can also be beneficially and preferentially used to protect the interior from dust, dirt, moisture, etc. By virtue of the fact that both the audio alarm and the visual alarm means are disposed within the backpack worn on a user's back, their respective heights are increased and the effectiveness of the overall alarm system is improved.

The backpack 1 has two shoulder carrying straps 2. Mounted on one carrying strap 2 is a panic switch 4 having a pull out strap pin 5 that activates and deactivates the multi-alarm system shown in FIG. 4. The pin 5 is preferably an audio-style bayonet plug that is received within a switch and confidently retained in position until intentionally withdrawn by a detent, as is known. As shown in more detail in FIG. 1, the panic switch 4 is electrically connected to the component compartment 6 via switch wiring 3 through the carrying strap 2, around the carrying compartment 10 and into the component compartment 6. In FIG. 3, the backpack 1 is shown with preferred adjustable anti-theft strap 12 attached to and interconnecting the two shoulder carrying straps 2. When properly buckled at buckle 32, the anti-theft strap is largely effective to prevent the backpack 1 from becoming accidentally removed or removed by a perpetrator.

As shown in FIG. 4, several components make up the multi-alarm system of the present invention, all of which are housed in the component compartment 6 of the backpack 1. A plastic injection molded base 26 and battery base 27 are utilized for mounting components. Two siren braces 19 and 29 are attached, preferably by screws, into the base 26. Siren brace 29 supports siren 14 and siren brace 19 supports siren 20, such that each of the sirens 14, 20 are positioned proximate one of the siren windows 9 when installed within the component compartment 6 and opposite each other. The sirens 14, 20 are preferably distributed by MCM Electronics and manufactured in Taiwan and should be loud enough to generate and attract attention from significant distances, preferably about 130 dB.

A circuit board brace 15 is attached to the base 26 and supports a strobe light circuit board 16, which further comprises a xenon flash tube 17. To protect the xenon flash tube 17, a clear rectangular heat resistant and shatter resistant strobe cover 18 is screwed into the base 26 and the battery base 27. The flash tube 17 is situation such that it is visible through strobe window 8 when installed in component compartment 6. A three-paneled reflector plate 25 having panels angled at 45 degrees is mounted to the strobe light circuit 16 behind the xenon flash tube 17 to intensify and increase the apparent size of the xenon flash tube 17 to improve the visibility of the visual signal.

A battery pack 24 fastens into the battery holders 23, which are mounted to the battery base 27. A battery cover 21 attaches to the battery base 27 with two screws 22. As shown, replacement of the batteries requires only opening the component compartment 6 and detachment of the battery cover 21, and does not require the carrying compartment 10 to be emptied so that access to the batteries can by obtained. However, since the battery cover is screwed into place, the possibility of an assailant being able to quick disable the alarm system is reduced.

Figure 5:
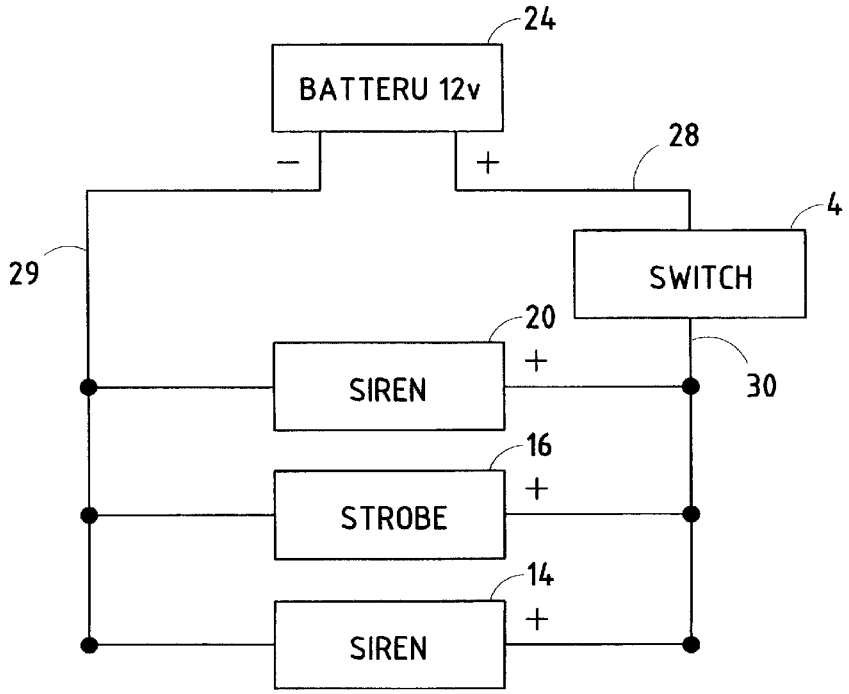
FIG. 5 is a general circuit diagram of the components for the personal security backpack of the present invention.

As shown in FIG. 5, the multi-alarm circuit diagram for the present invention is shown. The battery pack 24 is preferably 12 volts DC. A positive line 28 is connected to the panic switch 4. A panic switch line 30 is connected in series with the positive lines to each of the first siren 20, strobe light circuit board 16 and the second siren 14, each connected in parallel. The negative lines of these components are connected to the battery pack's negative line 29 to complete the systems circuit.

In operation, the personal security backpack of the present invention is easy to operate with high effectiveness. Preferably, since worn on the back and presented to the surroundings at a higher height, the strobe lamp 17 is more visible. Also, with sirens 14, 20 directed in directions opposite each other, the audible alarm is more readily heard. Before using the personal security backpack, only the strobe flap 11 need be folded under to expose the strobe 17. If the strobe flap 11 is not so folded, the sirens 14, 20 will still activate, although of course the effectiveness of the unit will be greatly reduced. No arming switch is necessary. The personal security backpack of the present invention is always armed and ready for use.

To use the personal security backpack of the present invention, the user simply grasps with one hand the pull out strap pin 5 of the panic switch 4, which by virtue of their location on the straps 2 remains near the user's chest and available at all times. When a threat arises, the user simply pulls the pull out strap pin 5, closing the circuit to the sirens 14, 20 and light strobe 17. The sirens 14, 20 activate and emit a loud distinctive noise through the sound windows 9, while the strobe lamp 17 emits a visual signal that is visible significant distances from the crime scene. After the alarm has been activated, the user may reinsert the pin 5 into the panic switch 4 to turn the system off. A particularly beneficial feature is that during an emergency, the user can simply activate the alarm with the pull out strap pin 5 and then throw the pull out strap pin away as the user moves away from the threat, thus making it nearly impossible to quickly disable the alarm and preventing the criminal from quickly turning off the siren.

The personal security backpack of the present invention will increase the likelihood of women and men escaping violent crimes, as well as deter criminals by providing users with several simultaneous distress alarm signals heard and seen from great distances from the crime scene. These signals will inform any and every person, preferably within a significant radius, that the user is being threatened, therefore warding the perpetrator away from the scene and promoting assistance from fellow citizens or law enforcement officials. It should also be noted that the personal security backpack of the present invention can be used by emergency personal to locate the user in a smoke-filled room to avoid the hazard of fire, to locate an otherwise incapacitated user or to startle and ward off stray dogs or other animals, and is therefore ideal for backpacking and hiking as well as urban settings.

The objects of the invention have thus been attained in an economical, practical, and facile manner. To wit, an effective and convenient personal security backpack contains an immediately available audio and visual alarm device which may be conveniently carried as a camouflaged as an ordinary accessory. While preferred embodiments and example configurations of the invention have been herein illustrated, shown and described, it is to be appreciated that various changes, rearrangements and modifications may be made therein, without departing from the scope of the invention as defined by the appended claims. It is intended that the specific embodiments and configurations disclosed are illustrative of the preferred and best modes for practicing the invention, and should not be interpreted as limitations on the scope of the invention as defined by the appended claims and it is to be appreciated that various changes, rearrangements and modifications may be made therein, without departing from the scope of the invention as defined by the appended claims.

What is claimed:

1. A personal security backpack having a pair of shoulder straps, a combination audible and visual alarm system, a compartment within which personal items may be carried, said backpack having a siren widow and a strobe light window, the backpack further comprising:

a battery pack;

an audio alarm siren disposed proximate said siren window and in selective electrical contact with said battery pack for emitting audio alarm signals when activated:

a visual strobe lamp disposed proximate said strobe lamp window and in selective electrical contact with said battery pack for emitting a conspicuous and highly visible visual signal when activated; and an externally accessible alarm panic switch mounted on one of the pair of shoulder straps of the backpack, the switch having an "on" and "off" position, whereby placing the switch in the "on" position simultaneously places said audio alarm siren and said visual strobe lamp in electrical contact with said battery pack to activate said audio alarm siren and said visual strobe lamp to attract the attention of nearby persons.

2. The personal security backpack of claim 1 further comprising a first compartment within which said personal items may be carried and a second compartment within which said alarm system is disposed, said second compartment having said siren widow and said strobe light window.

3. The personal security backpack of claim 1, wherein an anti-theft strap is attached to and interconnects the pair of shoulder straps such that the personal security backpack cannot be removed with the anti-theft strap in place.

4. The personal security backpack of claim 1, wherein the switch further comprises a pull out pin, such that the presence of the pull out pin corresponds to the switch "off" position and the absence of the pull out pin corresponds to the switch "on" position, whereby pulling the pull out pin from the switch simultaneously activates the audio alarm siren and the visual strobe lamp and the audio alarm siren and the visual strobe lamp may be deactivated only when the pull out pin is reinserted into the switch.

5. The personal security backpack of claim 2, wherein the component compartment is concealed beneath a water resistant compartment flap and the compartment flap further comprises a foldable strobe flap foldable underneath the compartment flap to selectively reveal said strobe lamp window in said component compartment.

6. The personal security backpack of claim 5, wherein said battery pack includes a battery cover and batteries, said batteries being disposed beneath said a battery cover and said batteries being accessible only through removal of said battery cover, said removal being accomplished only through the use of a tool.

7. The personal security backpack of claim 2, wherein the component compartment further comprises opposite side walls and a pair of siren windows positioned on each of said opposite side walls of said component compartment and a pair of audio alarm sirens disposed proximate each of said pair of siren windows on the external surface of the component compartment for emitting audio alarm signals when activated.

8. An improved backpack having a pair of shoulder straps and a main closable carrying compartment within which personal items may be carried, the improvement consisting of a combination audible and visual alarm system activated by a panic switch and a second closable compartment within which said alarm system is disposed and concealed, said second compartment having a siren widow and a strobe light window and said alarm system comprising an audio alarm siren disposed proximate said siren window for emitting audio alarm signals when activated and a visual strobe lamp disposed proximate said strobe light window for emitting a conspicuous and highly visible visual signal when activated, the panic switch being mounted on one of the pair of shoulder straps of the backpack and externally accessible when the system is being worn, the switch having an "on" and "off" position whereby the switch is placed in the "on" position by pulling on the pull pin to simultaneously activate the audio alarm siren and the visual strobe lamp to attract the attention of nearby persons.

9. The improved backpack of claim 8, wherein said panic switch comprises a pull out pin and a switch body having an "on" and "off" position, the system being activated upon pulling out the pull out pin from the switch body and deactivated upon placing the pin back into said switch body.

10. The improved backpack of claim 8, wherein the alarm system further comprises a battery power pack, a base plate disposed within said component compartment onto which are placed in electrical connection said siren and said strobe lamp, an electrical connector electrically connecting said siren and said strobe lamp to each of said battery power pack and said panic switch, whereby actuating said panic switch causes said system electrical connector to establish an electrical connection between said battery power pack and said siren and said strobe lamp.

11. The improved backpack of claim 8, wherein the system further comprises a battery power pack in electrical communication with the panic switch and the visual alarm generating means, such that placing the panic switch in the activated position simultaneously activates the audio alarm means and the visual alarm means.

12. In combination with a backpack to be worn by a user of the type having a pair of shoulder straps and a closable compartment for carrying personal items, a personal alarm system disposed within the backpack comprising a battery pack, a visual strobe lamp, an audio alarm siren, and an alarm actuator disposed on one of said shoulder straps for selectively and simultaneously activating the strobe lamp and siren, the backpack having a sound window and a strobe window, wherein activation of the siren produces an audio alarm signal through the siren window and activation of the strobe lamp generates a visible visual signal through the strobe window to attract attention to the user.

13. The combination of claim 12 wherein the backpack further comprises a pair of sound windows on opposing sides of said backpack and a pair of audio alarm sirens disposed proximate each of said sound windows, wherein activation of the sirens produces an audio alarm signal through each of said siren windows and activation of the strobe lamp generates a visible visual signal through the strobe window to attract attention to the user.

14. The combination of claim 12 wherein the alarm actuator disposed on one of said shoulder straps for selectively and simultaneously activating the strobe lamp and siren comprises a pin and switch assembly, whereby removal of the pin from the switch activates said strobe lamp and siren and wherein said pin is provided with a pull-cord immediately accessible to a user, the switch being electrically connected to the battery pack through an electrical connector extending from said one of the said pair of shoulder straps through the backpack and around said closable compartment for carrying personal items to said alarm system.

15. A multi-distress signal personal security system for attracting attention to a crime scene, the system comprising:

a backpack defined by a body portion having a compartment for holding personal items, a pair of shoulder straps, and an external outer skin having a plurality of sound openings directed in opposite directions and a visual window;

a siren disposed within the compartment proximate each of the sound openings for generating an audio alarm;

a visual signal strobe lamp disposed within the compartment proximate the visual window for generating a visual signal;

a battery power pack disposed within the compartment for selectively supplying power to the siren and the visual signal generator; and a panic switch disposed on one of said pair of shoulder straps operatively connected to the battery power pack and each of the sirens and visual signal strobe lamps for simultaneously activating the sirens and the visual signal strobe lamp, such that upon activation of the panic switch, the sirens generate an audio alarm through the sound openings in substantially 360 degrees and the visual signal generate displaces a visual signal through the visual window.

16. The multi-distress signal personal security system of claim 15 further comprising a main compartment for said holding personal items and an interior component compartment having said external outer skin having a plurality of sound openings directed in opposite directions and a visual window, wherein said siren is disposed within said component compartment proximate each of the sound openings for generating an audio alarm, said visual signal strobe lamp is disposed within said component compartment proximate the visual window for generating a visual signal, and said battery power pack is disposed within the component compartment for selectively supplying power to the siren and the visual signal generator.

* * * * *

UNITED STATES PATENT AND TRADEMARK OFFICE

CERTIFICATE OF CORRECTION

PATENT NO. : 6,130,616
DATED : October 10, 2000
INVENTOR(S) : Edric Sizemore

It is certified that error appears in the above-identified patent and that said Letters Patent is hereby corrected as shown below:

Col. 1, line 47;

"a activation" should be -- an activation --.

Col. 1, line 52;

"preferable included as a" should be -- preferably includes a --.

Col. 1, line 58;

"an detachable" should be -- a detachable --.

Col. 1, line 63;

"possibility" should be -- possibly --.

Col. 2, line 37;

"relies" should be -- rely --.

Col. 2, line 63;

"campus" should be -- campuses --.

Col. 3, line 17;

"art prior" should be -- prior art --.

Col. 3, line 46;

"an readily" should be -- a readily --.

Col. 5, line 25;

"preferably" should be -- preferable --.

Col. 5, line 31;

Delete "a."

UNITED STATES PATENT AND TRADEMARK OFFICE

CERTIFICATE OF CORRECTION

PATENT NO. : 6,130,616
DATED : October 10, 2000
INVENTOR(S) : Edric Sizemore

It is certified that error appears in the above-identified patent and that said Letters Patent is hereby corrected as shown below:

Col. 5, line 35;

"opens" should be -- openings --.

Col. 6, line 37;

"situation" should be -- situated --.

Col. 6, line 51;

"can by" should be -- can be --.

Col. 6, line 53;

"quick" should be -- quickly --.

Col. 7, line 34;

"warding" should be -- warding off --.

Col. 7, line 38;

"personal" should be -- personnel --.

Col. 7, line 47;

Delete "as a" before "camouflaged."

Col. 8, line 43;

Before "battery cover" delete "a."

Col. 8, line 61;

"widow" should be -- window --.

Col. 10, line 31;

"lamp," should be -- lamps, --.

UNITED STATES PATENT AND TRADEMARK OFFICE

CERTIFICATE OF CORRECTION

PATENT NO. : 6,130,616
DATED : October 10, 2000
INVENTOR(S) : Edric Sizemore

It is certified that error appears in the above-identified patent and that said Letters Patent is hereby corrected as shown below:

Col. 10, line 34;

"generate" should be -- generates -- and delete "displaces."

Col. 10, lines 37-38;

"said holding" should be -- holding said --.

Signed and Sealed this

Eighth Day of May, 2001

*Attest:*

Nicholas P. Godici

NICHOLAS P. GODICI

*Attesting Officer*

*Acting Director of the United States Patent and Trademark Office*